US010793962B2

(12) United States Patent
Sperling et al.

(10) Patent No.: US 10,793,962 B2
(45) Date of Patent: Oct. 6, 2020

(54) AQUEOUS INDIUM OR INDIUM ALLOY PLATING BATH AND PROCESS FOR DEPOSITION OF INDIUM OR AN INDIUM ALLOY

(71) Applicant: Atotech Deutschland GmbH, Berlin (DE)

(72) Inventors: Jan Sperling, Berlin (DE); Stefan Pieper, Berlin (DE); Grigory Vazhenin, Berlin (DE); Mauro Castellani, Berlin (DE); Andreas Kirbs, Berlin (DE); Dirk Rohde, Berlin (DE)

(73) Assignee: Atotech Deutschland GmbH, Berlin (DE)

( * ) Notice: Subject to any disclaimer, the term of this patent is extended or adjusted under 35 U.S.C. 154(b) by 190 days.

(21) Appl. No.: 15/779,641

(22) PCT Filed: Jan. 25, 2017

(86) PCT No.: PCT/EP2017/051484
§ 371 (c)(1),
(2) Date: May 29, 2018

(87) PCT Pub. No.: WO2017/129583
PCT Pub. Date: Aug. 3, 2017

(65) Prior Publication Data

US 2018/0355500 A1 Dec. 13, 2018

(30) Foreign Application Priority Data

Jan. 29, 2016 (EP) ..... 16153379

(51) Int. Cl.
*C23C 18/31* (2006.01)
*C25D 5/02* (2006.01)
(Continued)

(52) U.S. Cl.
CPC ..... *C25D 5/12* (2013.01); *C25D 3/38* (2013.01); *C25D 3/54* (2013.01); *C25D 3/56* (2013.01);
(Continued)

(58) Field of Classification Search
CPC . C23C 18/31; C23C 18/1601; C23C 18/1603; C25D 3/02; C25D 3/56; B05D 1/18
(Continued)

(56) References Cited

U.S. PATENT DOCUMENTS 2,287,948 A 6/1942 Smart
2,426,624 A 9/1947 Lien
(Continued)

FOREIGN PATENT DOCUMENTS

WO WO-2015065150 A1 * 5/2015 ..... C25D 5/10

OTHER PUBLICATIONS

Saito et al., "Effects of Electron-Withdrawing Substituents on DPPH Radical Scavenging Reactions of Protocatechuic Acid and Its Analogues in Alcoholic Solvents," Tetrahedron (2005), vol. 61, pp. 8101-8108. (Year: 2005).*
(Continued)

*Primary Examiner* — Edna Wong
(74) *Attorney, Agent, or Firm* — Renner, Otto, Boisselle & Sklar, LLP

(57) ABSTRACT

An aqueous indium or indium alloy plating bath comprising
a source of indium ions,
an acid,
a source of halide ions,
a surfactant according to formula (I)
(Continued)

(I)

wherein A is selected from branched or unbranched $C_{10}$-$C_{15}$-alkyl;

B is selected from the group consisting of hydrogen and alkyl;

m is an integer ranging from 5 to 25;

each R is independently from each other selected from hydrogen and methyl; and a dihydroxybenzene derivative according to formula (II)

(II)

wherein each X is independently selected from fluorine, chlorine, bromine, iodine, alkoxy, and nitro;

n is an integer ranging from 1 to 4, and a process for deposition of indium or an indium alloy wherein the disclosed bath is used.

12 Claims, 3 Drawing Sheets

(51) Int. Cl.

| | |
|---|---|
| ***C25D 5/12*** | (2006.01) |
| ***C25D 3/54*** | (2006.01) |
| ***C25D 3/56*** | (2006.01) |
| ***C25D 5/18*** | (2006.01) |
| ***C25D 5/40*** | (2006.01) |
| ***C25D 5/10*** | (2006.01) |
| ***C25D 5/48*** | (2006.01) |
| ***C25D 3/38*** | (2006.01) |
| ***C25D 5/50*** | (2006.01) |

(52) U.S. Cl.

CPC ..... *C25D 5/10* (2013.01); *C25D 5/18* (2013.01); *C25D 5/40* (2013.01); *C25D 5/48* (2013.01); *C25D 5/505* (2013.01)

(58) Field of Classification Search

USPC ..... 106/1.25; 205/238, 261; 427/430.1

See application file for complete search history.

(56) References Cited

U.S. PATENT DOCUMENTS

| | | | | |
|---|---|---|---|---|
| 2,458,839 | A | 1/1949 | Dyer, Jr. et al. | |
| 2,497,988 | A | 2/1950 | Green et al. | |
| 5,554,211 | A | 9/1996 | Bokisa et al. | |
| 8,092,667 | B2 | 1/2012 | Aksu et al. | |
| 8,460,533 | B2 | 6/2013 | Szocs et al. | |
| 2006/0113006 | A1* | 6/2006 | Masuda | C25D 3/32 205/302 |
| 2008/0268138 | A1 | 10/2008 | Reddington et al. | |
| 2010/0032305 | A1 | 2/2010 | Szocs et al. | |
| 2011/0103022 | A1 | 5/2011 | Szocs et al. | |
| 2013/0112564 | A1* | 5/2013 | Kleiman-Shwarsctein | C25D 3/56 205/104 |

OTHER PUBLICATIONS

Toth et al., "Structure of BRIJ-35 Nonionic Surfactant in Water: A Reverse Monte Carlo Study," Langmuir (2006), vol. 22, pp. 590-597. (Year: 2006).*

Pewnim et al., "Electrodeposition of Tin-Rich Cu—Sn Alloys From a Methanesulfonic Acid Electrolyte," Electrochemica Acta (2013), vol. 90, pp. 498-506. (Year: 2013).*

Q. Huang et al: "Electrodeposition of Indium on Copper for CIS and CIGS Solar Cell Applications", Journal of the Electrochemical Society, vol. 158, No. 2, Dec. 2, 2010, pp. D57-D61.

PCT/EP2017/051484; PCT International Search Report and Written Opinion of the International Searching Authority dated Apr. 3, 2017.

* cited by examiner

AQUEOUS INDIUM OR INDIUM ALLOY PLATING BATH AND PROCESS FOR DEPOSITION OF INDIUM OR AN INDIUM ALLOY

The present application is a U.S. National Stage Application based on and claiming benefit and priority under 35 U.S.C. § 371 of International Application No. PCT/EP2017/051484, filed 25 Jan. 2017, which in turn claims benefit of and priority to European Application No. 16153379.9 filed 29 Jan. 2016, the entirety of both of which is hereby incorporated herein by reference.

TECHNICAL FIELD

The present invention relates to an aqueous indium or indium alloy plating bath and process for deposition of indium or an indium alloy. With the bath and process, very smooth indium or indium alloy layers can be obtained.

BACKGROUND

Indium is a highly desirable metal in numerous industries because of its unique physical properties. For example, it is sufficiently soft such that it readily deforms and fills in microstructures between two mating parts, has a low melting temperature (156° C.) and a high thermal conductivity. Such properties enable indium for various uses in the electronic and related industries.

For example, indium may be used as thermal interface materials (TIMs). TIMs are critical to protect electronic devices such as integrated circuits (IC) and active semiconductor devices, for example, microprocessors, from exceeding their operational temperature limit. They enable bonding of the heat generating device (e.g. a silicon semiconductor) to a heat sink or a heat spreader (e.g. copper and aluminum components) without creating an excessive thermal barrier. The TIM may also be used in the assembly of other components of the heat sink or the heat spreader stack that composes the overall thermal impedance path.

Formation of an efficient thermal path is an important property of TIMs. The thermal path can be described in terms of effective thermal conductivity through the TIM. The effective thermal conductivity of the TIM is primarily due to the integrity of the interface between the TIMs and the heat spreader thermal conductivity as well as the (intrinsic) bulk thermal conductivity of the TIM. A variety of other properties are also important for a TIM depending on the particular application, for example: an ability to relax thermal expansion stresses when joining two materials (also referred to as "compliance"), an ability to form a mechanically sound joint that is stable during thermal cycling, a lack of sensitivity to moisture and temperature changes, manufacturing feasibility and cost.

The electrolytic deposition of indium has been established long ago in the art. There are various technical drawbacks known with electrolytic deposition of indium. Indium readily precipitates from aqueous solutions as hydroxide or oxide over a wide pH range which typically requires the employment of strong chelating agents and/or strongly alkaline or acidic plating baths. U.S. Pat. No. 2,497,988 discloses an electrolytic indium deposition process using cyanide as additive. The use of cyanide is highly undesired due to its toxicity. Alkaline processes employing various chelating agents such as oxalate are reported inter alia in U.S. Pat. Nos. 2,287,948 and 2,426,624. Alkaline media, however, cannot be used in the later stages of printed circuit manufacturing and semiconductors as solder masks and photoresists are labile to such treatments. Acidic indium plating baths are exemplarily taught in U.S. Pat. No. 2,458,839. Still, the deposits formed therewith are inhomogeneous and often have an island-like structure which renders them useless in the submicron regime. However, due to the increased miniaturization demands in today's electronic industries, these processes are not applicable as sub-micron indium or indium alloy layers are required.

To prevent above-mentioned island-like structures, U.S. Pat. No. 8,092,667 teaches a multi-step process. First, an intermediate layer consisting of indium and/or gallium as well as sulphur, selenium or another metal such as copper is formed and then, gallium, indium or alloys thereof are electrolytically deposited on said intermediate layer. Even though the process may provide indium layers as thin as 500 nm, this process is very laborious. The method taught therein requires more than one plating bath which is undesired as it increases process times and lengthens the required production line and consequently, the cost of manufactured components. Also, very smooth and pure indium layers cannot be provided as the required intermediate layer is made of an alloy with other elements.

A process for electrolytic indium deposition on copper is reported in Journal of the Electrochemical Society 2011, volume 158 (2), pages D57-D61. The reported deposition of indium abides the Stranski-Krastanov growth behaviour albeit in a slightly modified way. The process disclosed therein results in a quick formation of an intermetallic layer of up to 50 nm whereon island-like structures consisting of indium are then formed. However, the process described therein does not allow for the formation of smooth submicron indium layers. Indium or indium alloy layer thicknesses ranging from 50 or 100 nm to less than 1 μm or less than 500 nm cannot be provided by the method disclosed. Moreover, the disclosure only addresses copper as substrate but copper as a substrate is rarely used. The electronic industry usually applies barrier layers on top of copper lines or contacts to avert the electromigration of copper. This migration tendency of copper poses a serious risk to the life-time of electronic components.

Hydrogen evolution during electrolytic deposition of indium is another issue associated therewith. Hydrogen evolution should be minimized because hydrogen is a flammable gas and the formation of hydrogen is a competing reaction with the deposition of indium and thus reduces the efficiency of the indium deposition process. U.S. Pat. No. 8,460,533 B2 teaches an indium plating bath using a polymeric hydrogen scavenger. The polymeric hydrogen scavenger is an addition polymer of epichlorohydrin whose use is undesired due to its high toxicity. Also, it is not desired to provide individual bath formulations for each technical problem.

SUMMARY

It is an objective of the present invention to provide with a plating bath and a process for the deposition of smooth indium or indium alloy layers, particularly on metal or metal alloys, such as nickel and nickel alloys.

The present invention provides with a plating bath and a plating process according to the independent claims. Beneficial embodiments are laid down in dependent claims and this specification.

With the indium or indium alloy plating bath and the process for deposition of indium or an indium alloy of the present invention, in a general or in specific embodiments, one or more of the following benefits can be reached:

Smooth indium or indium alloy layers can be produced.

Thickness of indium or indium alloy layer, or of a combination of layers can be controlled, particularly when a potentiostatic process is used, as described hereinafter.

A sound bonding site for flip chips and solder bumps made of indium or indium alloys is provided.

The invention provides with an efficient indium or indium alloy deposition process.

The invention provides with an aqueous indium or indium alloy plating bath comprising a source of indium ions, an acid, a source of halide ions, a surfactant according to formula (I)

(I)

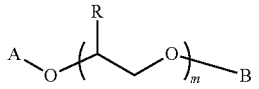

wherein A is selected from branched or unbranched $C_{10}$-$C_{15}$-alkyl, preferably branched or unbranched $C_{12}$-$C_{14}$-alkyl, more preferably branched or unbranched $C_{12}$-$C_{13}$-alkyl;

B is selected from the group consisting of hydrogen and alkyl, preferably hydrogen;

m is an integer ranging from 5 to 25, more preferably 10 to 25;

each R is independently from each other selected from hydrogen and methyl, preferably hydrogen only; and a dihydroxybenzene derivative according to formula (II)

(II)

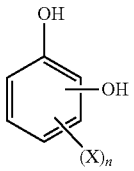

wherein each X is independently selected from fluorine, chlorine, bromine, iodine, preferably chlorine and bromine, more preferably chlorine; alkoxy, preferably methoxy; and nitro;

n is integer ranging from 1 to 4, preferably 1 to 2, more preferred 1.

DETAILED DESCRIPTION

Figure 1:
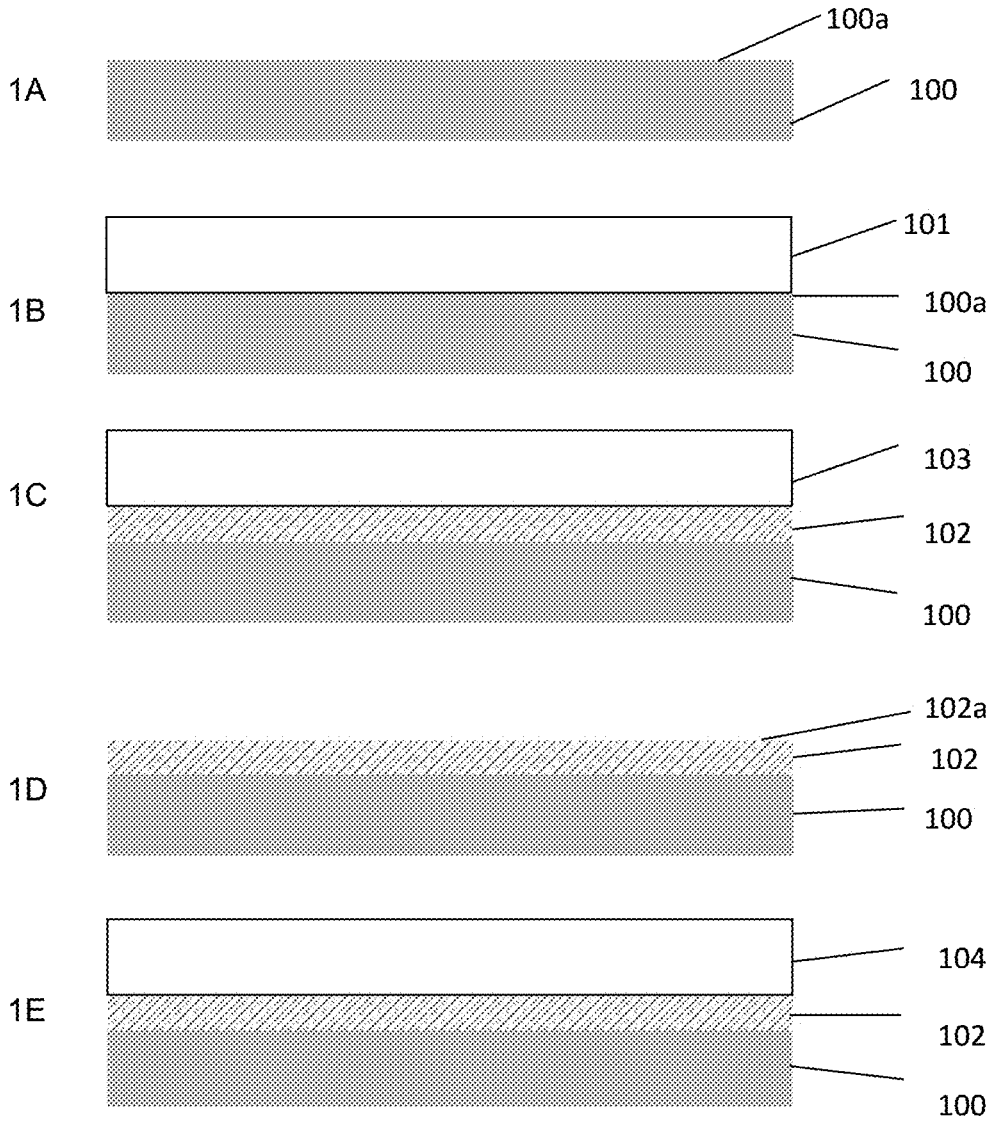
FIG. 1 shows a schematic, non-limiting representation of the process according to the invention.

Specific embodiments of the invention are given below. The embodiments can be performed singly or in any combination. The limits of the ratios and ranges disclosed herein may be combined in any combination.

In one embodiment, each X is independently selected from fluorine, chlorine, bromine, iodine, preferably chlorine and bromine, more preferably chlorine; and alkoxy, preferably methoxy.

It has been found that with a dihydroxybenzene derivative according to formula (II) the properties of the plating bath can be retained over longer periods of time. Particularly, a plating bath that was aged over a longer time is still able to produce a smooth indium or indium alloy layer.

Without wishing to be bound by theory, the dihydroxybenzene derivative is moreover believed to act as a controlling agent which reduces current flow. Controlled current flow leads to a controlled deposition of indium or indium alloy layers, which improves smoothness.

It is to be understood that in the plating bath more than one of a component as defined above or hereinafter can be present, for example more than one source of indium ions, more than one acid, more than one surfactant, more than one dihydroxybenzene derivative.

The indium or indium alloy plating bath is an aqueous solution. The term "aqueous solution" means that the prevailing liquid medium, which is the solvent in the solution, is water. Further liquids, that are miscible with water, as for example alcohols and other polar organic liquids, that are miscible with water, may be added.

The indium or indium alloy plating bath may be prepared by dissolving all components in aqueous liquid medium, preferably in water.

Preferably, the surfactant may be a mixture of one or more surfactants.

The surfactant is a non-ionic surfactant. In the surfactant, the length of the polyoxyalkylene chain can be statistically distributed. So the value of m may be an average value, preferably a number average degree of polymerisation, preferably measured by High Performance Liquid Chromatography. In other words, in the surfactant, a mixture of molecules with differing length of the polyoxyalkylene chain can be present.

Each R in the surfactant can independently from each other be selected from hydrogen and methyl with a ratio of hydrogen/methyl of 10/1 to 100/1. In other words, each R can be selected from hydrogen and methyl with a ratio of hydrogen/methyl of 10/1 to 100/1.

Preferably, in the surfactant, the ratio of hydrogen/methyl can be statistically distributed. So, in the surfactant, a mixture of molecules with differing ratio of hydrogen/methyl can be present. The value of the ratio of hydrogen/methyl may be an average value over all molecules present in the surfactant. Or each surfactant molecule within the mixture may have a ratio of hydrogen/methyl ranging from 10/1 to 100/1.

Preferably, this can be combined with polyoxyalkylene chains of different length, as stated above. So, the surfactant may vary both in the length and in the ratio of hydrogen/methyl of the polyoxyalkylene chain.

In another embodiment R is hydrogen. In this case the polyoxyalkylene is polyoxyethylene.

Branched alkyl is also called iso-alkyl. In a very specific embodiment, iso-alkyl can mean that the alkyl group shows a methyl, ethyl or propyl group at position 2 (carbon atom 2) of the main chain.

The surfactant can be included in the indium or indium alloy plating bath in a conventional amount. Particularly, the surfactant, is included in the indium or indium alloy plating bath in an amount of 0.1 g/L to 20 g/L, preferably from 0.5 g/L to 15 g/L, even more preferably 1 g/L to 15 g/L.

In a specific embodiment, the value for Hydrophilic-lipophilic balance (HLB value, measured according to the method of Griffin) is 13.0-18.0, preferably 15.0-18.0, more preferred 15.5-17.5. In other words, in the specific embodiment, the surfactant has a value for Hydrophilic-lipophilic balance (HLB value, determined according to the method of Griffin) ranging from 13.0-18.0, preferably 15.0-18.0, more preferred 15.5-17.5.

The dihydroxybenzene derivative is preferably a resorcinol derivative, a hydroquinone derivative or a catechol derivative; more preferably a resorcinol derivative or a hydroquinone derivative. In a specific embodiment, the dihydroxybenzene derivative is selected from one or more dihydroxybenzene derivatives from the group consisting of 4-chloro resorcinol, 5-methoxy resorcinol, chloro hydroquinone, 4-bromo resorcinol, 2-nitro resorcinol, and 4-chloro catechol; preferably 4-chloro resorcinol, 5-methoxy resorcinol, chloro hydroquinone, and 4-bromo resorcinol.

The concentration of dihydroxybenzene derivative in the plating bath preferably ranges from 10-1000 mg/L, preferably from 50-500 mg/L, more preferably 100-400 mg/L.

The indium or indium alloy plating bath comprises at least one source of indium ions. Suitable sources of indium ions are water-soluble indium salts and water-soluble indium complexes. Such sources of indium ions include, but are not limited to, indium salts of alkane sulphonic acids such as methanesulphonic acid, ethanesulphonic acid, butane sulphonic acid; indium salts of aromatic sulphonic acids such as benzenesulphonic acid and toluenesulphonic acid; salts of sulphamic acid; sulphate salts; chloride and bromide salts of indium; nitrate salts; hydroxide salts; indium oxides; fluoroborate salts; indium salts of carboxylic acids such as citric acid, acetoacetic acid, glyoxylic acid, pyruvic acid, glycolic acid, malonic acid, hydroxamic acid, iminodiacetic acid, salicylic acid, glyceric acid, succinic acid, malic acid, tartaric acid, hydroxybutyric acid; indium salts of amino acids such as arginine, aspartic acid, asparagine, glutamic acid, glycine, glutamine, leucine, lysine, threonine, isoleucine, and valine. Preferably, the source of indium ions is one or more than one indium salts of sulphuric acid, sulphamic acid, alkane sulphonic acids, aromatic sulphonic acids and carboxylic acids. More preferably, the source of indium ions is one or more than one indium salts of sulphuric acid and alkane sulphonic acids. The concentration of indium ions in the indium or indium alloy plating bath preferably ranges from 2.5 g/L to 200 g/L, preferably from 5 to 50 g/L, more preferably from 10 to 30 g/L.

The plating bath comprises at least one acid and/or a salt thereof to provide the desired acidic pH. Preferred pH ranges are given below. Such acids include, but are not limited to, alkane sulphonic acids such as methanesulphonic acid, ethanesulphonic acid; aryl sulphonic acids such as benzenesulphonic acid, toluenesulphonic acid; sulphamic acid; sulphuric acid; hydrochloric acid; hydrobromic acid; fluoroboric acid; boric acid; carboxylic acids such as citric acid, acetoacetic acid, glyoxylic acid, pyruvic acid, glycolic acid, malonic acid, hydroxamic acid, iminodiacetic acid, salicylic acid, glyceric acid, succinic acid, malic acid, tartaric acid, and hydroxybutyric acid; amino acids such as arginine, aspartic acid, asparagine, glutamic acid, glycine, glutamine, leucine, lysine, threonine, isoleucine and valine. One or more than one corresponding salts of above-mentioned acids also may be used. The acid may be selected from the group consisting of one or more of the following: an alkane sulfonic acid, an aryl sulfonic acid, sulfamic acid, a carboxylic acid (or a salt of the previously mentioned), and sulfuric acid. The acid may preferably be selected from the group consisting of one or more of the following: an alkane sulphonic acid, a sulfamic acid, or a salt thereof, and sulfuric acid. More preferably, the acid may be selected from the group consisting of one or more of the following: alkane sulfonic acid, or a salt thereof, and sulfuric acid. Even more preferably, the acid may be selected from the group consisting of one or more of the following: methanesulfonic acid, or a salt thereof, and sulfuric acid.

The concentration of the one or more than one acid or salts thereof range from 0.1 to 3 mol/L, preferably from 0.2 to 2.5 mol/L, more preferably from 0.3 to 2.0 mol/L.

The pH of the plating bath is preferably 7 or less.

First beneficial pH ranges are as follows: pH of −1 to 4 or 0 to 4, more preferably 0 to 3.5.

Second beneficial pH ranges are as follows: −1 to 1.4, more preferably 0 to 1.4, even more preferably 0 to 1, and most preferably pH 0 to <1 or pH<1. It has been found that with a pH of such range, very smooth indium or indium alloy surfaces can be obtained when indium or indium alloy is deposited on metal or metal alloy as substrate.

Third beneficial pH ranges are as follows: pH 1 to 4, preferably pH 1.5 to 4, more preferably pH 1.5 to 3, even more preferably pH 3-4, yet even more preferably pH 3-3.5. It has been found that with a pH of such range, very smooth indium or indium alloy surfaces can be obtained when indium or indium alloy is deposited on oxidic substrates.

A source of hydroxyl ions can be added, for example to adjust the desired pH. Suitable sources of hydroxyl ions are hydroxyl compounds, such as sodium hydroxide or potassium hydroxide.

In one embodiment the plating bath comprises a source of alkali metal cations and/or a source of alkaline earth metal cations. Preferred alkali metal cations are cations of Na, K and/or Li. Suitable sources of alkali metal cations are for example NaCl, KCl or LiCl. Preferred alkaline earth metal cations are cations of Ca and/or Mg. It has been shown that smoothness of indium or indium alloy surfaces can be improved when a source of alkali metal cations and/or a source of alkaline earth metal cations is added to the plating bath.

Generally, in the present invention one compound that is added to the bath can be a source of one or more of mentioned constituents. For example, the source of alkali metal cations or alkaline earth metal cations can also be a source of hydroxyl ions, for example in case of sodium hydroxide.

The indium or indium alloy plating bath comprises at least one source of halide ions. Such sources of halide ions can be water-soluble halide salts or halide complexes which liberate halide ions in aqueous media. Particularly suitable are alkali halide salts and hydrogen halides. Hydrogen halides can also act as acid and, if used in the indium or indium alloy plating bath, are in respect to their dual-functionality. Chloride ions are preferred. The concentration of halide ions is chosen in dependence of the concentration of indium ions in the indium or indium alloy plating bath. The concentration of halide ions preferably ranges from 1 molar equivalent of halide ions to indium ions to 10 molar equivalents of halide ions to indium ions. Halide ions lead to stabilization of indium ions in solution.

The acid and the source of halide ions can be added as one compound to the bath, for example when hydrochloric or hydrobromic acid are added to the bath. On the other hand, the source of halide ions and the acid can be different compounds, for example when above-mentioned acids are used which are selected from the group consisting of one or more of an alkane sulfonic acid, an aryl sulfonic acid, sulfamic acid, a carboxylic acid, and sulfuric acid.

The plating bath may comprise further optional components, such as a chelating agent for indium ions, a leveler, a carrier, a brightener and/or a second source of reducible metal ions which are described below.

The indium or indium alloy plating bath optionally comprises at least one chelating agent for indium ions. Such chelating agents for indium ions include, but are not limited to, carboxylic acids such as malonic acid and tartaric acid; hydroxy carboxylic acids such as citric acid and malic acid and salts thereof. Stronger chelating agents for indium ions such as ethylenediamine tetraacetic acid (EDTA) also may be used. The chelating agents for indium ions may be used alone or combinations thereof may be used. For example, varying amounts of a relatively strong chelating agent, such as EDTA can be used in combination with varying amounts of one or more weaker chelating agents such as malonic acid, citric acid, malic acid and tartaric acid to control the amount of indium which is available for electroplating. Chelating agents for indium ions may be used in conventional amounts. Typically, chelating agents for indium ions are used in concentrations of 0.001 mol/L to 3 mol/L.

In accordance with the teachings of U.S. Pat. No. 2,458,839 glucose may be added to improve the throwing power of the indium or indium alloy plating bath and/or the fineness of the indium or indium alloy layer formed.

The indium or indium alloy plating bath optionally comprises at least one leveler. Levelers include, but are not limited to, polyalkylene glycol ethers. Such ethers include, but are not limited to, dimethyl polyethylene glycol ether, di-tertiary butyl polyethylene glycol ether, polyethylene/polypropylene dimethyl ether (mixed or block copolymers), and octyl monomethyl polyalkylene ether (mixed or block copolymer). Such levelers are included in conventional amounts. Typically, such levelers may be included in amounts of 100 μg/L to 500 μg/L.

The indium or indium alloy plating bath optionally comprises at least one carrier. Carriers include, but are not limited to, phenanthroline and its derivatives such as 1,10-phenantroline; triethanolamine and its derivatives such as triethanolamine lauryl sulphate; sodium lauryl sulphate and ethoxylated ammonium lauryl sulphate; polyethyleneimine and its derivatives such as hydroxypropylpolyeneimine (HPPEI-200); and alkoxylated polymers. Such carriers are included in the indium or indium alloy plating bath in conventional amounts. Typically, carriers may be included in amounts of 200 mg/L to 5000 mg/L.

The indium or indium alloy plating bath optionally comprises at least one brightener. Brighteners include, but are not limited to, 3-(benzthiazolyl-2-thio)-propylsulphonic-acid, 3-mercapto-propan-1-sulphonic acid, ethylendithio-dipropylsulphonic-acid, bis-(p-sulphophenyl)-disulphide, bis-(ω-sulpho-butyl)-disulphide, bis-(ω-sulpho-hydroxy-propyl)-disulphide, bis-(ω-sulpho-propyl)-di-sulphide, bis-(ω-sulpho-propyl)-sulphide, methyl-(ω-sulpho-propyl)-disulphide, methyl-(ω-sulpho-propyl)-trisulphide, O-ethyl-dithiocarbonic-acid-S-(ω-sulphopropyl)-ester, thioglycol-acid, thiophosphoric-acid-O-ethyl-bis-(ω-sulphopropyl)-ester, 3-N,N-dimethylaminodithiocarbamoyl-1-propane-sulphonic acid, 3,3'-thiobis(1-propane-sulphonic acid), thiophosphoric-acid-tris-(ω-sulphopropyl)-ester and their corresponding salts. Typically, brighteners may be included in amounts of 0.01 mg/l to 100 mg/l, preferably from 0.05 mg/l to 10 mg/l.

The indium or indium alloy plating bath optionally comprises at least one second source of reducible metal ions. Reducible metal ions are metal ions which can be reduced under the conditions provided and hence, they are deposited together with indium forming an indium alloy. Such second source of reducible metal ions is preferably selected from the group consisting of aluminum, bismuth, copper, gallium, gold, lead, nickel, silver, tin, tungsten and zinc. More preferably, it is selected from gold, bismuth, silver and tin. The second source of reducible metal ions may be added to the indium or indium alloy plating bath as water-soluble metal salts or water-soluble metal complexes. Such water-soluble metal salts and complexes are well known. Many are commercially available or may be prepared from descriptions in the literature. Water-soluble metal salts and/or complexes are added to the indium or indium alloy plating bath in amounts sufficient to form an indium alloy having 1 wt.-% to 5 wt.-%, or such as from 2 wt.-% to 4 wt.-% of an alloying metal. Water-soluble metal salts may be added to the indium compositions in amounts such that the indium alloy has from 1 wt.-% to 3 wt.-% of an alloying metal.

Quantities of alloying metals in amounts of 3 wt.-% or less can improve TIM high temperature corrosion resistance and wetting and bonding to substrates such as silicon chips and, especially, flip chips. Additionally, alloying metals such as silver, bismuth and tin can form low melting point eutectics with indium making them even more useful for solder applications. The at least one second source of reducible metal ions metals is optionally included in the indium compositions in amounts of 0.01 g/L to 15 g/L, or such as 0.1 g/L to 10 g/L, or such as 1 g/L to 5 g/L.

It is preferred that the indium or indium alloy plating bath comprises only indium ions and no other intentionally added reducible metal ions as this facilitates the deposition process (disregarding trace impurities commonly present in technical raw materials). This shall mean in the context of this preferred embodiment of the present invention that 99 wt.-% or more of reducible metal ions are indium ions.

In another aspect, the present invention relates to a process for deposition of indium or an indium alloy comprising the steps i. providing a substrate having at least one surface;

ii contacting the at least one surface of said substrate with the indium or indium alloy plating bath as described above and thereby depositing an indium layer or indium alloy layer on at least a portion of the at least one surface.

In one embodiment, the surface is a metal surface or metal alloy surface. So, substrates used in the present invention may comprise at least one metal or metal alloy surface. The at least one metal or metal alloy surface is typically an outer layer or otherwise accessible for a deposition process.

The at least one metal or metal alloy surface of a substrate preferably comprises or consists of one or more than one of the following of the group consisting of nickel, aluminum, bismuth, cobalt, copper, gallium, gold, lead, ruthenium, silver, tin, titanium, tantalum, tungsten, zinc and alloys of the aforementioned. Alloys are meant to include—among others—at least alloys formed by two or more of said metals, an alloy of one or more than one of said metals with phosphorous, boron or phosphorous and boron, as well as the respective nitrides and silicides of said metals. Because of the migration tendency of copper and copper alloys, it is more preferred that the at least one metal or metal alloy surface does not consist of copper or an alloy thereof.

The at least one metal or metal alloy surface more preferably comprises or consists of nickel, cobalt, ruthenium, titanium, tantalum, tungsten or an alloy of the aforementioned. These metals or metal alloys are typically used as barrier layers in semiconductor and electronics industries on copper lines or contacts to prevent thermomigration or electromigration of copper from copper lines and contacts.

The at least one metal or metal alloy surface used in the present invention most preferably comprises or consists of nickel or of a nickel alloy, wherein the nickel alloys may be selected from the group consisting of nickel phosphorous alloy, nickel boron alloy, nickel tungsten phosphorous alloy, nickel tungsten boron alloy, nickel tungsten phosphorous boron alloy, nickel molybdenum phosphorous alloys, nickel molybdenum boron alloy, nickel molybdenum phosphorous boron alloy, nickel manganese phosphorous alloy, nickel manganese boron alloy and nickel manganese phosphorous boron alloy.

A metal surface in this context such as a nickel surface means a pure metal surface (disregarding any trace impurities commonly present in technical raw materials). Pure metal surfaces usually comprise at least 99 wt.-% of the respective metal. Above-mentioned alloys comprise typically more than 95 wt.-% of said elements forming the alloy, preferably more than 99 wt.-%.

In one embodiment, the surface is an oxidic surface, like a metal oxide surface or mixed metal oxide surface, e.g. indium tin oxide (ITO) surface. So, substrates used in the present invention may comprise at least one oxidic surface. The at least one oxidic surface is typically an outer layer or otherwise accessible for a deposition process.

All potentials mentioned in this specification are given in reference to the silver/silver chloride electrode with 3 mol/L KCl as electrolyte ($Ag^+|AgCl$). Percentages throughout this specification are weight-percentages (wt.-%) unless stated otherwise. Concentrations given in this specification refer to the volume of the entire solutions unless stated otherwise. The term "deposition" herein is to include the term "plating" which is defined as a deposition process from a plating bath. The term "electrolytic" is sometimes used synonymously in the art as "galvanic" or such processes are sometimes referred to as "electrodeposition". The terms "potential" and "voltage" are used interchangeably herein.

The process according to the invention optionally comprises the further step i.a. pretreatment of the at least one metal or metal alloy surface.

Pre-treatment of metal or metal alloy surfaces is known in the art. Such pretreatment encompasses, but is not limited to, cleaning and etching.

Cleaning steps use aqueous solutions which may be acidic or alkaline which optionally comprise surfactants and/or co-solvents such as glycols. Etching steps mostly employ mildly oxidising acidic solutions such as 1 mol/L sulphuric acid in conjunction with oxidising agents like hydrogen peroxide. Such etching steps are used inter alia to remove oxide layers or organic residues on metal or metal alloy surfaces.

The optional step i.a. may be included in the process according to the invention between steps i. and ii.

Depositing the indium layer or indium alloy layer in step ii. may be carried out by electrolytic deposition, particularly on a metal or metal alloy surface.

When the deposition of indium or indium alloys in step ii. is performed by an electrolytic deposition process on a metal or metal alloy surface, step ii. of the process according to the invention can comprise steps ii.a. to ii.c.

ii.a. Providing an indium or indium alloy plating bath;

ii.b. Contacting the indium or indium alloy plating bath with the metal or metal alloy surface; and ii.c. Applying an electrical current between the substrate and at least one anode and thereby depositing indium or indium alloy on at least a portion of the metal or metal alloy surface of the substrate.

Step ii.a. can be included at any stage in the process according to the invention before step ii.b. Step ii.c. is normally not started before step ii.b. Electrolytic deposition of indium or indium alloy is then performed during step ii.c.

In a specific embodiment, the electrolytic deposition in step ii. is a potentiostatic deposition process, preferably using a more cathodic potential than the open circuit potential, as explained and defined hereinafter.

A preferred potential for the electrolytic deposition of indium or indium alloy ranges from −0.8 to −1.4 V, yet even more preferably from −0.85 V to −1.3 V, yet even some more preferably from −0.9 to −1.2 V.

The time for the electrolytic deposition of indium or indium alloy depends on various factors such as the indium or indium alloy plating bath, temperature and potential used for the deposition. The time for the electrolytic deposition of indium or indium alloy preferably ranges from 0.1 to 60 seconds, more preferably from 1 to 45 seconds, even more preferably from 5 to 30 seconds. This duration is sufficient to provide a first indium or indium alloy layer on the metal or metal alloy surface. A composed phase of the deposited indium or indium alloy and the metal or metal alloy surface may be formed. A composed phase is in this description also referred to as composed layer. Longer plating times (although possible) result in thicker first indium or indium alloy layers which do not result in any beneficial effect but have to be removed in subsequent steps iii. Too long plating times also result in island-like indium or indium alloy structures with high roughness values (unless they are removed in subsequent steps).

Preferably, soluble indium anodes are used in the process according to the invention as they are used to replenish indium ions and thus keep the concentration of said ions at an acceptable level for efficient indium deposition.

The open circuit potential is the potential of the working electrode relative to the reference electrode when no potential or current is being applied to the cell.

It is useful to determine the open circuit potential (OCP) as it is dependent on various factors such as the exact composition of the indium or indium alloy plating bath, a metal or metal alloy surface, the pH of the indium or indium alloy plating bath and the temperature of the indium or indium alloy plating bath.

The open circuit potential can be determined by standard analytical means known to those skilled in the art. Useful analytical tools are cyclovoltammetric and linear voltammetric processes. The open circuit potential is the intersection point of the current-voltage-curve with the potential curve. The open circuit potential is inter alia defined in C. G. Zoski, "Handbook of Electrochemistry", Elsevier, Oxford, 1st edition, 2007, page 4. Alternatively, the open circuit potential can be defined and obtained as described in K. B. Oldham, J. C. Myland, "Fundamentals of Electrochemical Science", Academic Press, San Diego, 1st edition, 1994, pages 68-69.

It is advantageous to determine the open circuit potential because ideal potential values for the deposition and removal of indium or indium alloys can then be chosen rendering the overall process more efficient. If the open circuit potential is known for a given process sequence, it is not necessary to determine it anew. This means, that if a process has once been run, it is not required to determine the open circuit potential again (provided that similar or identical conditions are applied).

The process according to the invention optionally comprises the step: determination of the open circuit potential. During determination of the open circuit potential a current-voltage-curve (also referred to as current-versus-voltage-curve) can be obtained.

The determination of the open circuit potential can be used in the process according to the invention between steps i. and ii. and/or between steps ii. and iii., wherein iii. is described below, and/or between steps iii. and iv, wherein iv. is described below, and/or between steps iv. and steps v. and/or between steps v. and vi, which are described hereinafter. It is typically sufficient and thus preferable to use the step of determining the open circuit potential between i. and ii. and/or between steps ii. and iii.

In a specific embodiment of the process, the surface of the substrate is a metal or metal alloy surface, and

- in step ii. the indium or indium alloy layer is a first indium or indium alloy layer,
- in step ii. a composed phase is formed, made of the metal or metal alloy of said surface and at least a part of the first indium or indium alloy layer, and the process further comprises the steps:

- iii. removing partially or wholly the part of the first indium or indium alloy layer which has not been converted into the composed phase;
- iv. depositing a second indium or indium alloy layer on at least a portion of the surface obtained in step iii.

Step iv. is carried out by contacting at least a portion of the surface obtained in step iii with the indium or indium alloy plating bath according to the invention and depositing an indium layer or indium alloy layer on at least a portion of the at least one surface. The indium or indium alloy plating bath is preferably the same as used previously in the process, particularly in step ii.

By depositing the first indium or indium alloy layer on at least a portion of the metal or metal alloy surface, a composed phase is formed. This composed phase is made of the metal or metal alloy of the surface and at least a part of the first indium or indium alloy layer deposited thereon. The composed phase may be an intermetallic phase, a physical mixture of said components or a combination thereof. Preferably, the composed phase is or at least comprises an intermetallic phase of the deposited indium or indium alloy and the metal or metal alloy of the surface whereon indium or indium alloy is deposited. The composed phase such as the intermetallic phase forms at the phase boundary of the deposited first indium or indium alloy layer and the metal or metal alloy of said surface, typically by diffusion of one or more of said materials into the other. The composed phase comprises indium and the metal or metal alloy of the surface. The composed phase optionally comprises the second source of reducible metal ions (in its respective metallic form) if an indium alloy is deposited.

The composed phase made of indium or indium alloy and the metal or metal alloy surface forms instantly during the deposition of the first indium or indium alloy layer on at least a portion of the metal or metal alloy surface and thereafter.

The formation rate of the composed phase depends inter alia on the metal or metal alloy surface used in the process according to the invention. In case of barrier layers such as those made of nickel or nickel alloys, electrochemical experiments strongly suggest the formation of an intermetallic phase. This was entirely unexpected because it is known that nickel and nickel alloys are barrier layers with very low migration tendency and that for example nickel and indium do not form intermetallic phases when being subjected to conditions (particularly temperatures) as present in the process according to the invention.

Preferably, the layer thickness of the composed phase made of indium or indium alloy and the metal or metal alloy ranges from 0.1 to 100 nm, preferably from 1 to 50 nm.

The combined thickness of the composed layer and first indium or indium alloy layer obtained in step ii. preferably ranges from 0.1 to 500 nm, more preferably from 1 to 400 nm and even more preferably from 5 to 350 nm.

It is possible to wait for a certain period of time until the formation of the intermetallic phase slows down or ceases entirely before step iii. of the process according to the invention is carried out.

The inventors found that the composed phase differs significantly in its physical properties from the first indium or indium alloy layer which has not been converted into the composed phase and the metal or metal alloy surface. The composed phase has sometimes a different colour. The composed phase usually can be more glossy and/or smoother than either of the two aforementioned are. These findings suggest that the composed phase is often an intermetallic phase.

The removal of at least a part of the first indium or indium alloy layer which has not been converted into the composed layer in step iii. is preferably an electrolytic stripping process. Stripping means in the context of the present invention the electrochemical dissolution of metallic indium or indium alloy of the indium or indium alloy layers transforming it into dissolved indium ions (and possibly other ions if an indium alloy is stripped). The stripping of (at least a part of) the first indium or indium alloy layer which has not been converted into the composed phase is a galvanostatic stripping process or a potentiostatic stripping process. Preferably, a potentiostatic stripping process is used because this eliminates the risk of stripping involuntarily the composed phase formed in step ii. particularly if an intermetallic phase is formed.

A potentiostatic stripping process preferably uses a more anodic potential than the open circuit potential. It is advantageous that if the composed phase formed in step ii. is an intermetallic phase, the risk of involuntarily stripping it, is reduced as the required potential for stripping an intermetallic phase is usually more anodic than the potential required for stripping of indium or indium alloys. This allows for a facilitated process control.

It is advantageous that using a potentiostatic stripping process facilitates the process according to the invention and renders the need for strict process control (such as time control) of this step unnecessary.

As was outlined above, the potential required to remove the composed phase, especially for an intermetallic phase, may have a more anodic potential than the potential required to strip indium.

Typically, the potentiostatic stripping process uses a potential ranging from 0 to −0.6 V, preferably from −0.2 to −0.4 V.

The required time for the stripping process depends on various parameters such as the amount of indium or indium alloy to be removed (i.e. the indium or indium alloy layer thickness) and the applied potential. The time for the electrolytic stripping process preferably ranges from 0.1 seconds until substantially all indium is removed which has not been converted into the composed phase. Substantially all indium means in this context 90 wt.-% or more, preferably 95 wt.-% or more, more preferably 99 wt.-% or more, of indium which has not been converted into the composed phase. It is preferred that in step iii., at least 90 wt.-% of indium or indium alloy indium which has not been converted into the composed phase is removed; it is more preferred that 95 wt.-% or more of said indium or indium alloy, even more preferably 99 wt.-% or more thereof are removed in step iii. The latter—especially in the cases where intermetallic phases are formed—may be accomplished once the anodic current drops (measured by potentiometer). Usually, 0.1 to 60 seconds are sufficient; 1 to 45 seconds are preferably used. More preferably, the time for the electrolytic stripping process ranges from 5 to 30 seconds.

The deposition of indium or indium alloy in step iv. is possible by any known means in the art. The deposition of indium or indium alloy in step iv. may be carried out by electrolytic deposition, electroless deposition, chemical vapour deposition or physical vapour deposition. Useful electroless indium or indium alloy plating baths are for example disclosed in U.S. Pat. No. 5,554,211 (A).

Preferably, the deposition of the second indium or indium alloy layer in step iv. is performed by electrolytic deposition. This allows for all indium or indium alloy deposition and removal steps of the entire process to be run in a single indium or indium alloy plating bath. It is preferred to run all indium or indium alloy deposition and removal steps of the whole process according to the invention in a single indium or indium alloy plating bath as this renders the overall process more efficient as e.g. it shortens the production line.

In analogy to step ii., step iv. may comprise similar steps iv.a to iv.c which correspond to or are identical with steps ii.a. to ii.c. As stated above, the indium or indium alloy plating bath of steps ii.a and iv.a preferably is the same. Also, the substrate may remain in the indium or indium alloy plating bath for all indium or indium alloy deposition and removal steps (including steps ii. and iv.).

Preferably, the electrolytic deposition of the second indium or indium alloy layer is a potentiostatic deposition process using a more cathodic potential than the open circuit potential.

The preferred potential for the electrolytic deposition of the second indium or indium alloy layer in step iv. ranges from −0.8 to −1.4 V, yet even more preferably from −0.85 V to −1.3 V, yet even some more preferably from −0.9 to −1.2 V.

The time for the electrolytic deposition of the second indium or indium alloy layer in step iv. preferably ranges from 0.1 seconds until the desired thickness of the indium layer has been obtained. It ranges preferably from 1 to 60 seconds, more preferably from 5 to 30 seconds.

As already stated above, the electrolytic deposition of indium or indium alloy in step ii. and step iv. is in a preferred embodiment a potentiostatic indium deposition process using a more cathodic potential than the open circuit potential. More preferably, the potential used for the electrolytic deposition of indium or indium alloy in step ii. and the potential used for the electrolytic deposition of indium or indium alloy in step iv. is the same as this facilitates the process control.

It is optional to include steps v. and vi. into the process according to the invention v. removing partially or wholly the second indium or indium alloy layer;
vi. depositing a third indium or indium alloy layer on at least a portion of the surface obtained in step v.

Steps v. and vi. are included into the process after step iv. has been completed.

Step vi. may be carried out by contacting at least a portion of the surface obtained in step v. with the indium or indium alloy plating bath according to the invention. The indium or indium alloy plating bath is preferably the same as used previously in the process, particularly in step ii and/or iv.

It is also possible within the means of the present invention to repeat steps v. and vi. more than once and thus form a fourth, a fifth or an indium or indium alloy layer of any higher order until the desired thickness of the intermetallic phase and the indium or indium alloy layer has been obtained. It is preferred to remove the second indium or indium alloy layer (or any higher order indium or indium alloy layer) only partially to build up the indium or indium alloy deposit. Partially means that at least 20 wt.-% or 40 wt.-% or 60 wt.-% or 80 wt.-% of the indium or indium alloy deposited in step iv. remain on the modified surface.

The parameters given for step iii. are useful for step v. (or any repetition thereof). Also, the parameters for step iv. can be employed for step vi. (or any repetition thereof).

The combined thickness of the composed layer and all indium or indium alloy layers thereon preferably ranges from 1 to 1000 nm, more preferably from 50 to 800 nm, even more preferably from 100 to 500 nm.

In view of the disclosure given above, the process of the invention may comprise the following steps which are carried out in the given order i. providing a substrate having at least one metal or metal alloy surface;
i.a. optionally, pre-treatment of the at least one metal or metal alloy surface;
ii. electrolytically depositing a first indium or indium alloy layer on at least a portion of said surface whereby a composed phase is formed made of the metal or metal alloy of said surface and at least a part of the first indium or indium alloy layer
iii. electrolytically stripping partially or wholly the first indium or indium alloy layer which has not been converted into the composed phase;
iv. depositing a second indium or indium alloy layer on at least a portion of the surface obtained in step iii.;
v. optionally, electrolytically stripping partially or wholly the second indium or indium alloy layer; and
vi. optionally, depositing a third indium or indium alloy layer on at least a portion of the surface obtained in step v.

Preferably, the deposition of the second indium or indium alloy layer is an electrolytical deposition of indium or indium alloy in step iv. This also applies to the formation of any further indium or indium alloy deposition (such as steps. vi. and so forth).

The preferred electrolytic deposition of indium or indium alloy in step ii. and/or step iv., and/or one or more of further deposition steps, are potentiostatic indium deposition processes using a more cathodic potential than the open circuit potential. Preferably, the employed potential for the electrolytic deposition of indium or indium alloy ranges from the minimum of the current-voltage-curve to the more cathodic inflexion point of the current-voltage-curve or the more cathodic local maximum. The minimum of the curve is more cathodic than the open circuit potential. By choosing a potential in above-defined ranges the formation of hydrogen is minimised rendering the overall process more efficient.

The potential required to remove the composed phase, especially the intermetallic phase, has a more anodic potential than the potential required to strip indium. For removing indium or indium alloy, and preferably not removing the composed phase, a potentiostatic stripping process with a more anodic potential than the open circuit potential may be used. The potential for the potentiostatic stripping process more preferably ranges from the open circuit potential to the intersection point (which is more anodic than the open circuit potential) of the current-voltage-curve with the voltage axis or the next local minimum. This preferable range allows for a selective stripping of the indium or indium alloy layer without removing the composed phase (or the intermetallic phase) which is required for the deposition of smooth indium layers.

It was unexpectedly found that the deposition of indium or indium alloys on the composed phase and particularly on intermetallic phases resulted in smooth indium or indium alloy deposits. The formation of island-like structures can be significantly reduced or entirely prevented (compare samples 1 and 11 in the Examples). Such smooth indium or indium alloy deposits are useful for a variety of applications, particularly in electronic industries such as flip chip appliances and in the formation of solder connections.

Only a single indium or indium alloy plating bath may be used to carry out the entire process according to the invention. That is, only one bath may be used for/during all steps of deposition and removing indium or indium alloy. It is an advantage of the present invention that only a single indium or indium alloy plating bath is required to carry out the entire process according to the invention. By changing the potential (and thus the mode of deposition/stripping) the whole process according to the invention can be carried out in a single indium or indium alloy plating bath.

The process according to the invention optionally comprises further rinsing and drying steps. Rinsing is typically done with solvents such as water. Drying can be accomplished by any means known in the art such as the subjecting the substrate to hot air streams or placing them into the hot furnaces.

Products obtainable according to the process of the invention are also a subject matter of this invention. Products, obtainable by using the plating bath of this invention in a process of this invention are a further subject matter of this invention.

The process according to the invention is useful to provide substrates having at least one metal or metal alloy surface whereon a layer array is present, comprising or consisting of—in this order a) said at least one metal or metal alloy surface;

b) a composed phase made of indium or indium alloy and the metal or metal alloy from said surface. Such composed phase is obtainable according to the process of this invention; and c) one or more than one indium or indium alloy layers. Such layers are obtainable according to the process of this invention.

Substrates comprising said layer array are referred to herein as "finished substrates". Said substrate is an object of this invention, independently from the process for making it.

Preferably, the finished substrates comprise an intermetallic phase made of indium or indium alloy and the metal or metal alloy from the substrate's metal or metal alloy surface.

The one or more than one indium or indium alloy layers in combination with the composed phase in the finished substrates preferably have a thickness of 1 to 1000 nm, more preferably of 50 to 800 nm, even more preferably of 100 to 500 nm. The finished products or finished substrates are manufactured by the process according to the invention.

The temperature of the indium or indium alloy plating bath during the process according to the invention ranges from the melting point to the boiling point of the indium or indium alloy plating bath. Typically, from −20° C. to 80° C., preferably from 5 to 50° C., more preferably from 10 to 40° C., even more preferably from 15 to 35° C.

The indium or indium alloy plating bath is preferably agitated during the process according to the invention. Agitation can be provided by gas feeds such as air or inert gases, liquid feeds such as those to replenish components of the indium or indium alloy plating bath, stirring, movement of the at least one substrate or at least one electrode in the indium or indium alloy plating bath or by any other means known in the art.

The surface of the substrate, particularly a metal or metal alloy surface, and or a first (second, third etc.) indium or indium alloy layer can be contacted with the indium or indium alloy plating bath by any means known in the art. Preferably, it is contacted by dipping the substrate into the indium or indium alloy plating bath to facilitate the process.

The following non-limiting examples further illustrate the present invention.

EXAMPLES

1. General Procedures

1.1 Electrochemical Analysis (Relates to Step of Determining the Open Circuit Potential)

An Autolab potentiostat (Metrohm) controlled by Nova software was used as a power source for the electrochemical study. Current-versus-voltage curves were recorded using a three electrode setup at a sweep rate of 10 mV/s versus $Ag^+$|AgCl-reference.

1.2 Surface Roughness

The topography of indium or indium alloy layers was characterised by means of a white light interferometer (Atos GmbH). The image size for determination of surface roughness had an area of 60×60 μm. The surface roughness was calculated by NanoScope Analysis software. The values inferred from topography data are given to correspond to the average roughness, $S_a$. The surface roughness was measured in the centre of the sample where roughnesses are usually the most distinct.

2. Examples and Comparative Examples—Experiments

2.1 Examples

All aqueous electrolytes were composed of the following chemicals at a given concentration, except of example 12, in which the addition of NaOH was omitted. As this comparative example contained no acid the pH was in the desired range even without adding NaOH.

A) surfactants: 10 g/l

Following surfactants were used:

Brij® 35 (Brij is a registered trademark of Croda International PLC;

CAS Number 9002-92-0),

Structural Formula $C_{12}H_{25}(OCH_2CH_2)_nOH$, n~23;

Molecular Weight 1199.54;

HLB 16.9

Lutensol® TO 8 (Lutensol is a registered trademark of BASF SE);

Structural Formula $RO(CH_2CH_2O)_xH$, wherein R=iso $C_{13}H_{17}$, x about 8;

Molecular Weight about 600;

HLB about 13

Lutensol® TO 15 (Lutensol is a registered trademark of BASF SE);

Structural Formula $RO(CH_2CH_2O)_xH$, wherein R=iso $C_{13}H_{17}$, x about 15;

Molecular Weight about 850;

HLB about 15.5

Tergitol® L64 (Tergitol is a registered trademark of Dow company); chemical structure: Polyether polyol; HLB 15 (for comparative Example)

polyethylene glycol, molecular weight 800 (PEG 800), HLB 20 (for comparative Example)

B) aromatic compound (dihydroxybenzene derivative in examples of the invention): $2.075\times10^{-3}$ mol/l (in case of 4-chloro resorcinol: 300 mg/l)

C) Source of Indium ions: $InCl_3$, 38.525 g/l

D) acid: 1.563 mol/l

E) source of halide ions: HCl (37 w %), 19.797 ml/l

F) NaOH: 30.465 g/l

All variations of aromatic compounds and those of the acids occurred with the same molar concentration, all surfactant variations with the same mass per volume.

Substrates were nickelized wafer coupons, with an active electrode area of 2×2 $cm^2$.

Electrochemical pretreatment: Three consecutive cyclic voltammograms of each of the electrolytes were acquired in the potential range from −0.3 V to −1.2 V vs. Ag/AgCl at a scan-rate of 10 mV/s by means of a three electrode setup with the very same working electrode. The counter electrode was composed of pure indium, whereas the working electrode was initially composed of nickel. Each scan was run from higher potential towards lower potentials and, subsequently, upwards, thereby depositing in the first place pure indium in the cathodic regime, upon which, removal of the pure indium is occurring in the anodic regime.

Figure 3:
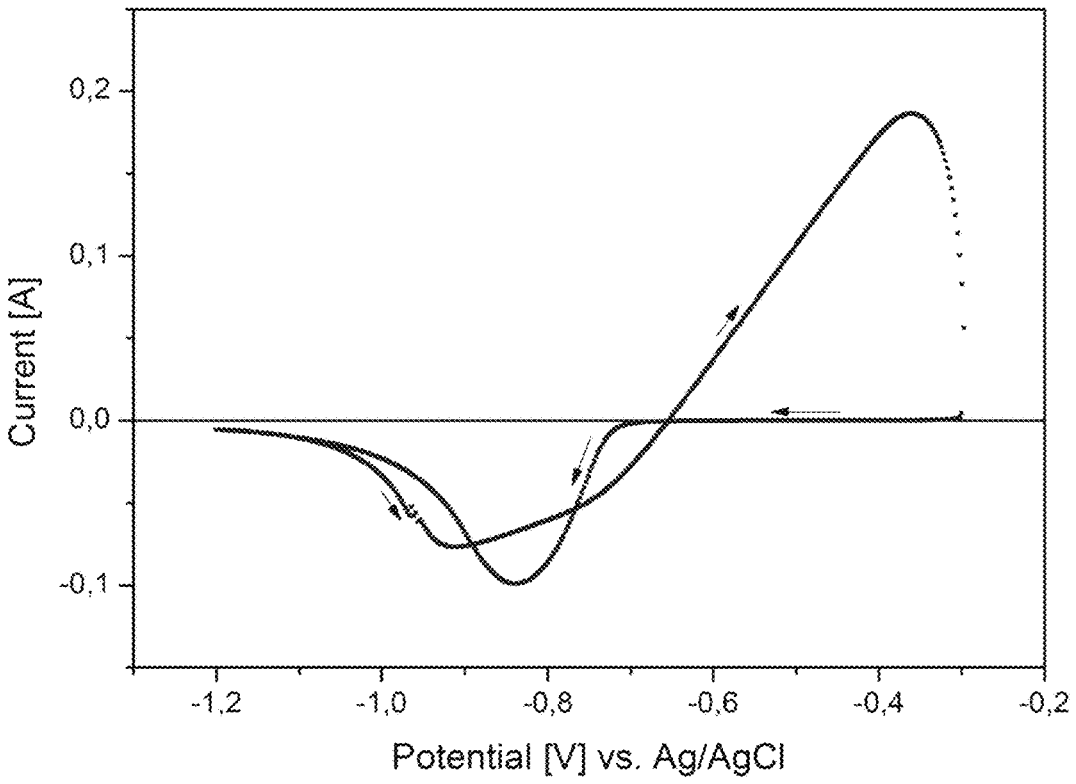
FIG. 3 shows a typical current-voltage-curve of the indium plating bath.

Deposition of the pure indium layer was performed potentiostatically at the corresponding potential determined during said precycling procedure. Therein, the last of the three cyclic voltammograms of the pretreatment procedure was taken as a reference. FIG. 3 shows a schematic current-voltage-curve. The duration of the electrochemical deposition is defined by the maximum integrated charge being at (2.2 C)/(4 $cm^2$)=0.55 C/$cm^2$. Pretreatment and subsequent deposition occurred within the very same bath.

Measurement of the surface roughness was done according to the method described above.

The instrument used for electrochemical deposition was a PGSTAT 204 from Metrohm-Autolab.

2.2 Comparative Examples

In the comparative examples, the same compositions and methods were used as described above in 2.1 with respect to the examples of the invention, except for the changes shown in the table below:

The following table is an overview of the surfactants and aromatic compounds used in the examples and comparative examples (changes in italic, underlined letters):

| Example No. | Acid | Surfactant | HLB | Aromatic compound |
|---|---|---|---|---|
| 1 (comp.) | methane sulfonic acid | Brij ® 35 | 16.9 | *resorcinol* |
| 2 | methane sulfonic acid | Brij ® 35 | 16.9 | 5-methoxy resorcinol |
| 3 | methane sulfonic acid | Lutensol ® TO 8 | 13 | 4-chloro resorcinol |
| 4 (comp.) | methane sulfonic acid | *Tergitol ® L64* | 15 | 4-chloro resorcinol |
| 5 | methane sulfonic acid | Lutensol ® TO 15 | 15.5 | 4-chloro resorcinol |
| 6 (comp.) | methane sulfonic acid | *PEG 800* | 20 | 4-chloro resorcinol |
| 7 | methane sulfonic acid | Brij ® 35 | 16.9 | 4-bromo resorcinol |
| 8 | methane sulfonic acid | Brij ® 35 | 16.9 | chloro hydroquinone |
| 9 | methane sulfonic acid | Brij ® 35 | 16.9 | 4-chloro resorcinol L64 |
| 10 (comp.) | methane sulfonic acid | *none* | — | *none* |
| 11 | sulfuric acid | Brij ® 35 | 16.9 | 4-chloro resorcinol |
| 12 (comp.) | *none* | Brij ® 35 | 16.9 | 4-chloro resorcinol |

3. Examples and Comparative Examples—Results of Experiments

The following table shows the results of roughness measurements. The number in the column "sample" refers to the number of the example according to invention or comparative example.

Each surface roughness value is an average value from 5 measuring points.

| Sample | Surface roughness $S_a$/nm |
|---|---|
| 1 (comp.) | 33 |
| 2 | 31 |
| 3 | 31 |
| 4 (comp.) | 114 |
| 5 | 30 |
| 6 (comp.) | 43 |
| 7 | 30 |
| 8 | 28 |
| 9 | 26 |
| 10 (comp.) | 85 |
| 11 | 26 |
| 12 (comp.) | 50 |

4. Further Examples and Comparative Examples

Further depositions of indium layers were performed from indium deposition baths containing further inventive and comparative aromatic compounds (see Table 3). Substrates, composition of the aqueous indium electrolytes and deposition conditions were as described in sections 1 and 2 above. Surface roughness $S_a$ of the indium layers deposited were measured according to sections 1.2 and 3 above and the results are summarized in Table 3.

TABLE 3

Surface roughness $S_a$ of indium layers deposited from indium electrolytes containing further inventive and comparative aromatic compounds

| Example No. | Acid | Surfactant | Aromatic compound | Surface roughness $S_a$/nm |
|---|---|---|---|---|
| 13 | methane sulfonic acid | Brij ® 35 | 2-Nitro resorcinol | 31 |
| 14 | methane sulfonic acid | Brij ® 35 | 4-Chloro catechol | 30 |
| 15 (comp.) | methane sulfonic acid | Brij ® 35 | *Pyro catechol* | 79 |

5. Process with Deposition and Stripping Steps

Figure 2:
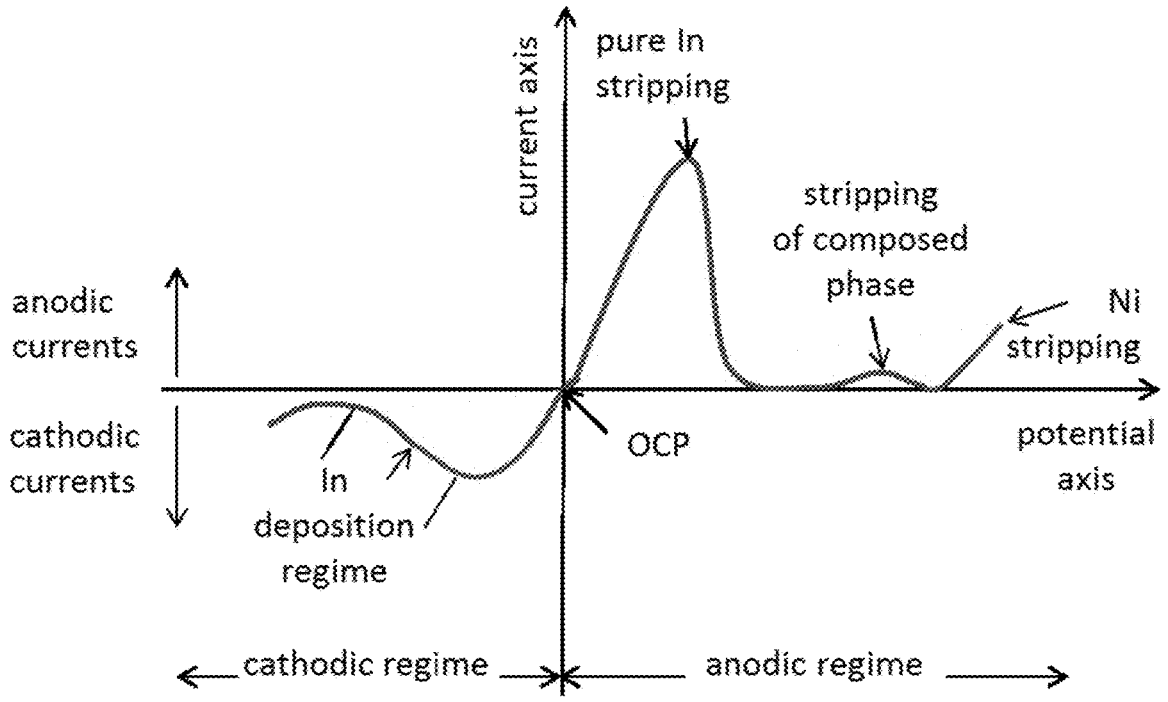
FIG. 2 shows a schematic current-voltage-curve of an indium or indium alloy plating bath.

FIGS. 1 and 2 explain the process of the invention, with deposition and stripping steps, in a schematic manner.

As shown in FIG. 1A, a substrate (100) having at least one metal or metal alloy surface (100*a*) is provided. Substrates typically used in the present invention are printed circuit boards, wafer substrates, IC (integrated circuit) substrates, chip carriers, circuit carriers, interconnect devices and display devices.

FIG. 1B shows step ii., wherein a first indium or indium alloy layer is deposited on at least a portion of the metal or metal alloy surface provided in step i. The substrate (100) having at least one metal or metal alloy surface (100*a*) is depicted with the first indium or indium alloy layer (101) on said surface.

FIG. 1C. shows a composed phase made of indium or indium alloy and the metal or metal alloy surface, which forms instantly during the deposition of the first indium or indium alloy layer on at least a portion of the metal or metal alloy surface and thereafter. The substrate (100) having at least one metal or metal alloy surface (100*a*) is depicted with the composed phase (102) in between the parts of the first indium or indium alloy layer (103) and the metal or metal alloy which have not been converted into the composed layer.

FIG. 1D shows how in step iii. the part of the first indium or indium alloy layer which has not been converted into the composed layer is partially or wholly removed. In FIG. 1D, the entire removal of the first indium or indium alloy layer which has not been converted into the composed layer is shown. The substrate (100) having at least one metal or metal alloy surface (not highlighted in this figure) is covered by the composed phase 102).

The surface obtained in step iii. (102*a*) is characterised in that it is less rough than the first indium or indium alloy layer (e.g. 103 in FIG. 1C).

FIG. 1E illustrates step iv., wherein a second indium or indium alloy layer is deposited on at least a portion of the surface obtained in step iii. The substrate having at least one metal or metal alloy surface is first covered by the composed phase (102) and then by the second indium or indium alloy layer (104) which has been formed on the surface obtained in step iii. (which corresponds in this Figure to the surface of the composed phase).

FIG. 2 shows a schematic current-voltage-curve. In this curve, the preferred potential ranges for the electrolytic indium or indium alloy deposition and its stripping are depicted.

The invention claimed is:

1. A process for deposition of indium or an indium alloy comprising the steps of:

i. providing a substrate (100) having at least one metal or metal alloy surface;

ii. contacting the at least one surface of said substrate (100) with an aqueous indium or indium alloy plating bath comprising:

a source of indium ions, an acid, a source of halide ions, a surfactant according to formula (I)

(I)

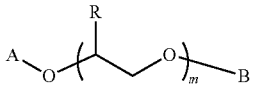

wherein A is selected from branched or unbranched $C_{10}$-$C_{15}$-alkyl;

B is selected from the group consisting of hydrogen and alkyl;

m is an integer ranging from 5 to 25;

each R is independently from each other selected from hydrogen and methyl; and a dihydroxybenzene derivative according to formula (II)

(II)

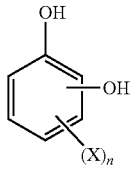

wherein each X is independently selected from fluorine, chlorine, bromine, iodine, alkoxy, and nitro;

n is an integer ranging from 1 to 4, wherein, when the aqueous indium or indium alloy plating bath is an indium alloy plating bath, an alloying reducible metal is selected from the group consisting of aluminum, bismuth, copper, gold, lead, nickel, silver, tin, tungsten and zinc;

and thereby depositing an indium layer or indium alloy layer on at least a portion of the at least one surface, and wherein in step ii. the indium or indium alloy layer is a first indium or indium alloy layer (101), in step ii. a composed phase (102) is formed, made of the metal or metal alloy of said surface (100*a*) and at least a part of the first indium or indium alloy layer (101), wherein the process further comprises the steps:

iii. removing partially or wholly the part of the first indium or indium alloy layer which has not been converted into the composed phase (103); and iv. depositing a second indium or indium alloy layer (104) on at least a portion of the surface obtained in step iii (102*a*).

2. The process according to claim 1, wherein depositing the indium layer or indium alloy layer in step ii. is carried out by electrolytic deposition.

3. The process according to claim 2, wherein the electrolytic deposition is a potentiostatic deposition process.

4. The process according claim 1, wherein depositing the second indium layer or indium alloy layer (104) in step iv. is carried out by electrolytic deposition and the electrolytic deposition is a potentiostatic deposition process.

5. The process according claim 1, wherein step iii. is carried out by a electrolytic stripping process and the electrolytic stripping process is a potentiostatic stripping process.

6. The process according to claim 1, wherein each R is selected from hydrogen and methyl such that hydrogen and methyl are present in a ratio of hydrogen/methyl of 10/1 to 100/1.

7. The process according to claim 1, wherein R is hydrogen.

8. The process according to claim 1, wherein the acid is selected from one or more of alkane sulfonic acid and sulfuric acid.

9. The process according to claim 1, wherein the surfactant has a value for hydrophilic-lipophilic balance (HLB value, determined according to method of Griffin) ranging from 13.0-18.0.

10. The process according to claim 1, wherein the dihydroxybenzene derivative is 4-chloro resorcinol, 5-methoxy resorcinol, chloro hydroquinone, 4-bromo resorcinol, 2-nitro resorcinol or 4-chloro catechol.

11. The process according to claim 1, wherein the aqueous indium or indium alloy plating bath has a pH of −1 to 4.

12. The process according to claim 1, wherein the aqueous indium or indium alloy plating bath further comprises a source of alkali metal cations and/or a source of alkaline earth metal cations.

* * * * *